US006878063B2

(12) United States Patent
Manfredi et al.

(10) Patent No.: US 6,878,063 B2
(45) Date of Patent: Apr. 12, 2005

(54) METHOD FOR IMPLEMENTING SCHEDULED RETURN PLAY AT GAMING MACHINE NETWORKS

(75) Inventors: Vincent S. Manfredi, Las Vegas, NV (US); Richard J. Schneider, Corvallis, OR (US); William J. Turner, Corvallis, OR (US); Robert P. Bartholomew, Corvallis, OR (US); Lawrence R. Pitman, Las Vegas, NV (US)

(73) Assignee: Acres Gaming Incorporated, Las Vegas, NV (US)

( * ) Notice: Subject to any disclaimer, the term of this patent is extended or adjusted under 35 U.S.C. 154(b) by 0 days.

(21) Appl. No.: 10/389,633

(22) Filed: Mar. 13, 2003

(65) Prior Publication Data

US 2003/0176219 A1 Sep. 18, 2003

Related U.S. Application Data

(62) Division of application No. 09/967,337, filed on Sep. 28, 2001, now Pat. No. 6,575,832.

(51) Int. Cl.[7] ..... A63F 9/24
(52) U.S. Cl. ..... 463/25
(58) Field of Search ..... 463/9, 16, 17, 463/18, 19, 20, 23, 25, 26, 27, 28, 29, 40, 41, 42

(56) References Cited

U.S. PATENT DOCUMENTS 5,370,399 A * 12/1994 Liverance ..... 463/23
5,465,982 A * 11/1995 Rebane ..... 463/9
6,113,495 A * 9/2000 Walker et al. ..... 463/42
6,174,237 B1 * 1/2001 Stephenson ..... 463/42
6,319,125 B1 11/2001 Acres
2002/0151359 A1 * 10/2002 Rowe ..... 463/29
2002/0187834 A1 * 12/2002 Rowe et al. ..... 463/42
2003/0032474 A1 * 2/2003 Kaminkow ..... 463/25

FOREIGN PATENT DOCUMENTS

| | | |
|---|---|---|
| NZ | 500706 | 4/2000 |
| NZ | 330189 | 7/2000 |
| ZA | 98/3158 | 10/1999 |

OTHER PUBLICATIONS

Abstract of New Zealand 500706 (see above).
Abstract of New Zealand 330189 (see above).

* cited by examiner

*Primary Examiner*—Michael O'Neill
(74) *Attorney, Agent, or Firm*—Marger Johnson & McCollom, P.C.

(57) ABSTRACT

A method of providing incentive to play gaming devices during certain off-peak hours comprises three types of periods: an earning period over which earned credits are accumulated responsive to the level of play on the gaming device, a redeeming period where the earned credits can be played, and a regular period where credits are neither earnable or playable. In this way, the player is given an incentive to play during certain times of the week which are otherwise off-peak playing times where the casino might be relatively empty. The amount of credits earned and redeemed can also be dependent upon the player level so that more valuable customers are given preferential bonuses to encourage play.

9 Claims, 12 Drawing Sheets

METHOD FOR IMPLEMENTING SCHEDULED RETURN PLAY AT GAMING MACHINE NETWORKS

This application is a divisional of U.S. patent application Ser. No. 09/967,337 filed on Sep. 28, 2001, now U.S. Pat. No. 6,575,832, which is herein incorporated by reference in it's entirety.

BACKGROUND OF THE INVENTION

1. Field of the Invention

The present invention relates to gaming machine networks, and more particularly to a method for implementing incentives for players of such gaming machines to encourage play of the gaming machines at specified times.

2. Description of the Related Art

Linking together electronic slot machines on a computer network is known in the art. One example of such a network is disclosed in U.S. Pat. No. 5,572,882 to Acres et al. ("the '882 patent"), which is assigned to the assignee of the present application. The '882 patent is incorporated herein by reference for all purposes. The '882 patent also discloses a number of different bonuses, which pay awards to players at their respective slot machines that are over and above any awards dictated by the pay tables of the machines.

One such bonus award is paid randomly to one of the players via that player's slot machine. Once a slot machine is selected for this type of award, a computer on the network transmits a command to the slot machine that causes it to pay a predetermined amount from the hopper of the machine to the player.

Another type of award is personal to each player and is based on the level of that player's play. As discussed in the '882 patent, a player may be issued a player-tracking card that is insertable into a card reader associated with each slot machine. The network collects data relating to the player's play and stores it in a central computer. Personal awards to the player may be a predetermined amount or a percentage of the player's total play. They are awarded upon the occurrence of a predetermined event, e.g., when the player's cumulative wagers exceed a predetermined level.

Player tracking points is another award sometimes given to players of networked gaming devices. Each player who uses their card accrues a predetermined number of points for each dollar wagered on the networking gaming machines. Some systems award points for jackpots won on the machines. In any event, the player is eligible to redeem his or her points for complimentary meals, merchandise, or other awards determined by the casino that operates the slot machines. In addition to point accrual based on play, points are often awarded to induce players to sign up for carded play.

In still another effort to induce play on machines, casinos sometimes provide a player with the ability to make complimentary wagers, or to make half price wagers. An example of the foregoing incentives implemented on networked slot machines is disclosed in co-owned U.S. Pat. No. 6,244,958 (the '958 patent). The '958 patent is incorporated herein by reference for all purposes.

A concern of the gaming casinos operating the games is the overhead caused by unused machines. As casinos are generally located at resort locations, the frequency of play on particular machines is more popular at some times than others. Off-peak days, that is periods during which there is low play of the machines, typically occur on Mondays, Tuesdays and Thursdays. Off-peak hours during those days typically occur in the midmornings (that is, after 4am) but could also occur during times where other events around the casino (such as shows, meals, etc.) attract customers away from the gaming machines. Casino operators are generally interested in driving customers to play during these time periods to increase play throughout the casino.

Another desire for casino operators is to attract higher quality customers to the casino. Although it is known to grant frequent, well-known, or high-rolling players extra benefits for visiting the casino, such as complementary tickets, rooms, and shows, the competitiveness of the casino industry requires that something more be contemplated.

Accordingly, the need remains for a method for encouraging play by desired customers, especially during off-peak playing times within the casino.

SUMMARY OF THE INVENTION

A method of providing incentive to play gaming devices during certain off-peak hours whereby the casino creates a player account accessible by the host computer and designates a time in which credits can be earned by the player responsive to his or her play on the gaming devices and a time in which the earned credits can be redeemed and played. The player gains access to his regular account balance, and to his earned credit account balance, by inserting a player ID card within a card reader at the gaming device. The ID) information is confirmed and the player record—including identification, account balance, and level of play—is sent as a data f block to the gaming device. Play during certain predesignated time periods throughout the week is carefully tracked, and earned (but not yet usable) credits are awarded to the player account responsive to the player exceeding certain thresholds of play. To redeem the credits for play, the player must return to play at a later, predesignated period of time, e.g. Thursday afternoon from 12pm to 3pm. In this way, the player is given an incentive to play during certain times of the week which are otherwise off-peak playing times where the casino might be relatively empty. The amount of credits earned and redeemed can also be dependent upon the player level so that more valuable customers are given preferential bonuses to encourage play.

These and other objects and advantages of the present invention will become more fully apparent when the following detailed description is read in view of the accompanying drawings, wherein:

DETAILED DESCRIPTION OF THE PREFERRED EMBODIMENT

Figure 1:
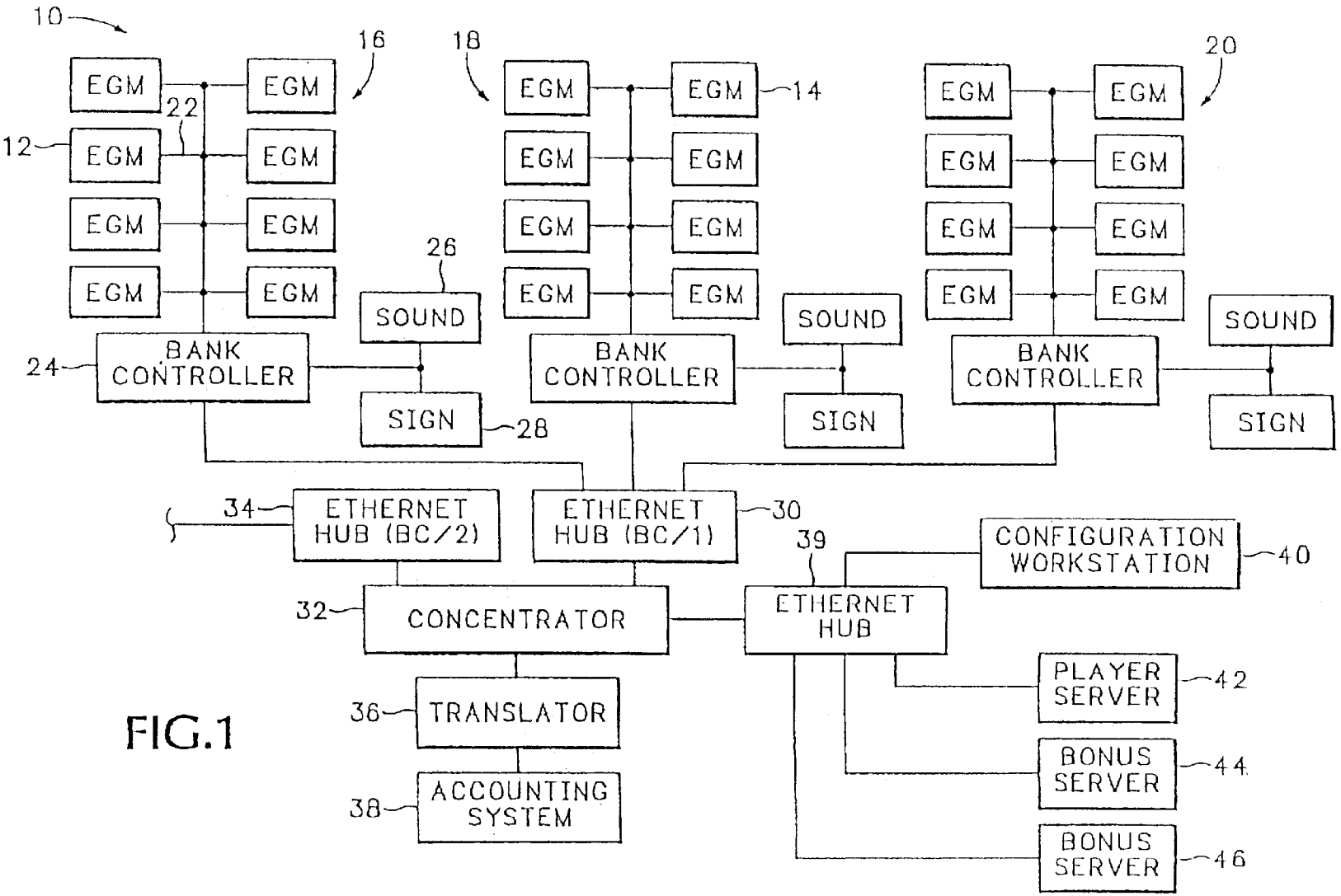
FIG. 1 is a schematic diagram of a plurality of electronic gaming machines interconnected by a computer network to a host computer in accordance with the present invention.

Turning now to FIG. 1, indicated generally at 10 is a schematic diagram illustrating electronic gaming machines (EGMs), like EGMs 12, 14, interconnected by a computer network. Included therein are three banks, indicated generally at 16, 18, 20, of EGMs. Each EGM is connected via a network connection, like connection 22, to a bank controller 24. In the present embodiment of the invention, each bank controller comprises a processor that facilitates data communication between the EGMs in its associated bank and the other components on the network. The bank controller also includes a CD ROM drive for transmitting digitized sound effects, such as music and the like, to a speaker 26 responsive to commands issued over the network to bank controller 24. The bank controller is also connected to an electronic sign 28 that displays information, such as jackpot amounts and the like, visible to players of machines on bank 16. Such displays are generated and changed responsive to commands issued over the network to bank controller 24. Each of the other banks 18, 20 of EGMs include associated bank controllers, speakers, and signs as shown, which operate in substantially the same manner.

Ethernet hub 30 connects each of the bank controllers associated with banks 16, 18, 20 of EGMs to a concentrator 32. Another Ethernet hub 34 connects similar bank controllers (not shown), each associated with an additional bank of EGMs (also not shown), to concentrator 32. The concentrator functions as a data control switch to route data from each of the banks to a translator 36. The translator comprises a compatibility buffer between the concentrator and a proprietary accounting system 38. It functions to place all the data gathered from each of the bank controllers into a format compatible with accounting system 38. In the present embodiment of the invention, translator 38 comprises an Intel Pentium 200 MHz Processor operating Microsoft Windows NT 4.0.

Another Ethernet hub 39 is connected to a configuration workstation 40, a player server 42, and to bonus servers 44, 46. Hub 39 facilitates data flow to or from workstation 40 and servers 42, 44, 46.

The configuration workstation 40 comprises a personal computer including a keyboard, Intel Pentium Processor, and Ethernet card. It is the primary user interface with the network. A program operating on configuration workstation 40 enables a casino operator to configure criteria for certain bonusing events running on bonus servers 44, 46 using a graphic user interface such as that shown in FIGS. 3–12. Criteria set to operate a bonusing scheme of the present invention include such features as a calendar for setting earning and redemption time periods, earning tables, multipliers, player payments adjusted for player ranking, level or group, message working, pool names, etc.

The player server 42 comprises a microcomputer that is used to control messages that appear on displays associated with each EGM. Player server 42 includes an Intel Pentium Processor and an Ethernet card. The player server comprises a database coupled to the bonusing system shown in FIG. 1 that stores all points and credits accumulated by the player according to player ID number, including earned credits, redeemed credits, player points, etc.

Bonus servers 44,46 each comprise a microcomputer used to control bonus applications on the network. Each bonus application comprises a set of rules for awarding jackpots in excess of those established by the pay tables on each EGM. For example, some bonus awards may be made randomly, while others may be made to linked groups of EGMs operating in a progressive jackpot mode. Examples of bonuses that can be implemented on the network are disclosed in co-owned U.S. Patent No. 6,319,125 (the '125 patent), which is incorporated herein by reference for all purposes. This co-pending application also describes in more detail features of the network, like that shown in FIG. 1, that may be used to implement the present invention. The '882 patent also discloses bonuses that can be implemented by bonus servers 44,46 and a network that could be used to implement the present invention.

Figure 2:
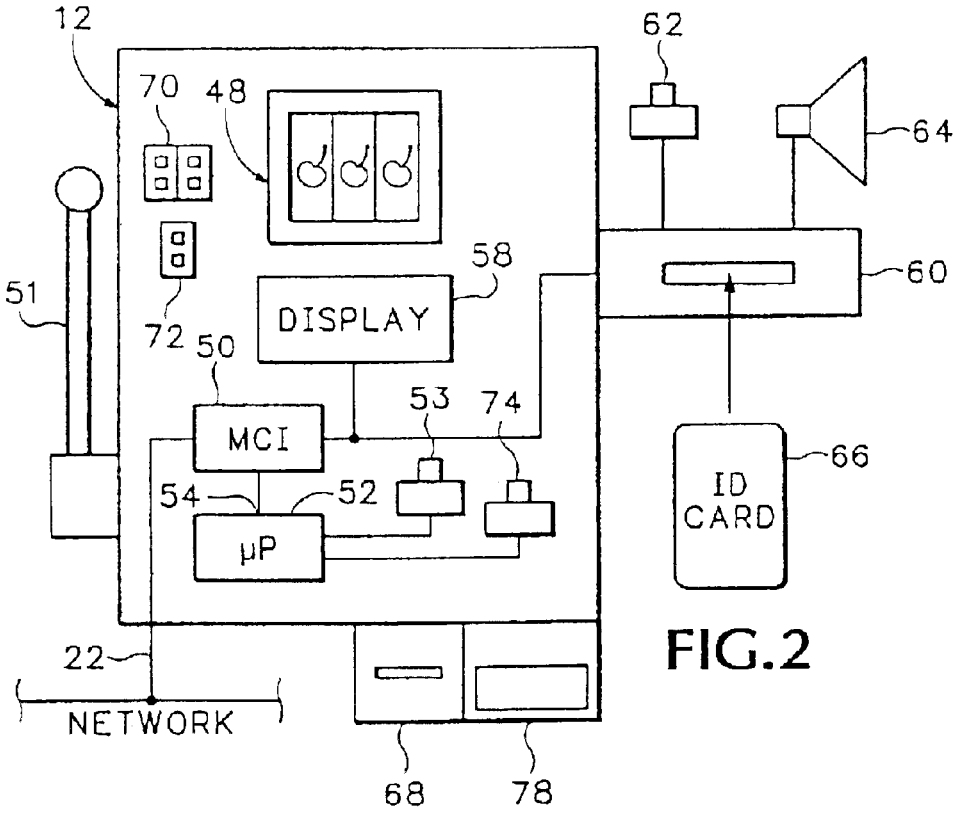
FIG. 2 is a schematic diagram of a slot machine and associated hardware implemented in accordance with the present invention.

FIG. 2 is a highly schematic representation of an electronic slot machine—typical of each of the machines in the network—that incorporates network communications hardware as described hereinafter. This hardware is described in the '882 patent, and is referred to therein as a data communications node. Preferably the network communications hardware is like that disclosed in the '125 patent, namely a machine communication interface (MCI) 50. MCI 50 facilitates communication between the network, via connection 22, and microprocessor 52, which controls the operation of EGM 12. This communication occurs via a serial port 54 on the microprocessor to which MCI 50 is connected. It is possible for the MCI to be fitted with a microprocessor so that all functions of the machine are controlled by the MCI.

Included in EGM 12 are three reels, indicated generally at 48. Each reel includes a plurality of different symbols thereon. The reels spin in response to a pull on handle 51 or actuation of a spin button 53 after a wager is made. It will be appreciated that the bonus scheme taught in the present invention is not dependent upon the type of game played at the three, four, or five reel slots, poker, video blackjack, or other type of game can be played according to the bonus scheme presented.

MCI 50 includes a random access memory (RAM), which can be used as later described herein. The MCI also facilitates communication between the network and a vacuum florescent display (VFD) 58, a card reader 60, a player-actuated push button 62, and a speaker 64. The VFD 58 includes display elements and memory and its operation is well known in the art and thus not described further here. Various messages specified within the configuration workstation 40 during bonus scheme setup and stored within the bonus servers 42, 44 are uploaded to the MCI 50 and forwarded for storage in the VFD memory. The MCI causes various messages to be displayed on the VFD 58 upon the occurrence of specified events tracked by the MCI responsive to play on the EMG 12 by sending a signal to the VFD reflective of a message ID number. The memory within the VFD cross-references the message number to identify and then display the selected message on the display to the player.

Before describing play according to the invention, description will first be made of typical play on a slot machine, like EGM 12. A player plays EGM 12 by placing a wager and then pulling handle 51 or depressing spin button 53. The wager may be placed by inserting a bill into a bill acceptor 68. A typical slot machine, like EGM 12, includes a coin acceptor (not shown) that may also be used by the player to make a wager. A credit meter 70 is a numeric display that indicates the total number of credits available for the player to wager. The credits are in the base denomination of the machine. For example, in a nickel slot machine, when a five dollar bill is inserted into bill acceptor 68, a credit of 100 appears on credit meter 70. To place a wager, the player depresses a coin-in button (not shown), which transfers a credit from the credit meter 70 to a coin-in meter 72. Each time the button is depressed a single credit transfers to the coin-in meter up to a maximum bet that can be placed on a single play of the machine. In addition, a maximum-bet button (also not shown) may be provided to immediately transfer the maximum number of credits that can be wagered on a single play from the credit meter 70 to the coin-in meter 72. It is understood that some machine would be able to utilize the VFD 58 to display all such information instead of numeric displays 70, 72 and that the actual display mechanism used is not important to the general implementation of the invention.

When coin-in meter 72 reflects the number of credits that the player intends to wager, the player depresses spin button 53 thereby initiating a game.

The player may choose to have any jackpot won applied to credit meter 70. When the player wishes to cash out, the player depresses a cash-out button 74, which causes the credits on meter 70 to be paid in coins to the player at a hopper 78, which is part of machine 12. The machine consequently pays to the player, via hopper 78, the number of coins—in the base denomination of the machine—that appear on credit meter 70.

Card reader 60 reads a player-tracking card 66 that is issued by the casino to individual players who choose to have such a card. Card reader 60 and player-tracking card 66 are known in the art, as are player-tracking systems, examples being disclosed in the '882 patent and '125 patent. Briefly summarizing such a system, a player registers with the casino prior to commencing gaming. The casino issues a unique player-tracking card to the player and opens a corresponding player account that is stored on accounting system 38 (in FIG. 1). Accounting system 38 is referred to herein as a host computer. It should be appreciated, however, that the host computer can be distributed on the network and could include multiple processors or memories. The account includes the player's name and mailing address and perhaps other information of interest to the casino in connection with marketing efforts. Prior to playing one of the EGMs in FIG. 1, the player inserts card 66 into reader 60 thus permitting accounting system 38 to track player activity, such as amounts wagered and won (e.g. level of play) and rate of play.

To induce the player to use the card, the casino awards each player points proportional to the money wagered by the player. Players consequently accrue points at a rate related to the amount wagered. The points are displayed on display 58. In prior art player tracking systems, the player may take his or her card to a special desk in the casino where a casino employee scans the card to determine how many accrued points are in the player's account. The player may then redeem points for selected merchandise, meals in casino restaurants, or the like, which each have assigned point values.

Before describing the manner in which the present invention is implemented on the network of slot machines depicted in FIG. 1, consideration will first be given to terminology used in the description.

First, a player-tracking account is one that is established by the casino, typically for an identified player—although the invention could be implemented with an anonymous account. The player-tracking account is referred to herein as a player account. When the player inserts his or her card into card reader 60 of EGM 12, information related to that player's account is fetched from the host computer, transmitted on the network, and stored in the RAM included in MCI 50 of EGM 12. Such information includes player-tracking points, which are referred to generally herein as account points. In accordance with the present invention, the player's account may also include credits that may be transferred by the player from the player's account to credit meter 70 on the machine and thereafter wagered by the player. These credits in the player's account are referred to herein as account credits and are awarded and redeemed as described hereinafter. Credits appearing on credit meter 70 of EGM 12 are referred to herein as meter credits.

As used herein the term jackpot indicates an award made resulting from the pay table on one of the EGMs while the term bonus indicates an award that does not result from the machine's pay table. The '125 patent and '882 patent include many examples of bonuses. The term award is intended to encompass any payment given to a player of one of the EGM's and includes both jackpots and bonuses. The term base credits is the term used to signify the bonus granted to a base player ("level 1") depending upon that player's level of play—that is, how much that player has wagered over the period being tracked. The term earned credits signifies the bonus stored within the player account at the player server 42 in consideration of that player's actual player level—that is, the base credits amount multiplied by the earned credit multiplier. As will be appreciated in the description included further below, earned credits are not yet available for play until the redemption period. The earned credit multiplier is a number between 1 and 10 and is typically a higher value for higher level players. In this way, higher level (e.g. more desirable) players are encouraged to play more often at the casino by receiving a higher bonus award for a certain level of play. The term redeemed credits signifies the credits actually available for play by the player on a gaming machine during the redemption period. The number of redeemed credits is calculated according to a preferred embodiment of the invention by multiplying the number of earned credits in the player account by a redeem credit multiplier value, set by the gaming operator to encourage players to play at certain times. Once redeemed credits are played at the gaming machine, they are considered played credits.

One way in which account credits may be applied to a player's account is as an incentive to open the account. In other words, when the account is opened by the casino, an account credit, e.g., $5, is applied to the account. The following Table 1, which is described in more detail below, sets forth the sequence followed by the player to redeem the account credits for play on EGM 12.

TABLE 1

| | |
|---|---|
| 1. | Player account information, including account credits and points, is stored in MCI 50 RAM responsive to insertion of card 66 into reader 60. |
| 2. | Player places wager by inserting bill into bill acceptor 68 or coin into the coin acceptor (not shown). |
| 3. | Player plays game by pushing spin button 53. |
| 4. | Responsive to play, the account credits are automatically debited in the amount of the wager and applied to credit meter 70. |
| 5. | Steps 3 and 4 are repeated so long as the player wishes to play. |
| 6. | When the player is finished playing, he or she pushes cash-out button 74 and withdraws card 66 from reader 60. |

When the player inserts card 66 into reader 60, the account information is fetched from the host computer in step 1 above. The amount of account credit available appears on display 58 in the denomination of the machine being played. In the example above, with an initial account credit in the amount of $5, when the card is inserted into a nickel slot machine display 58 shows: Account Credit=100. If the player was using a dollar slot machine, display 58 would show: Account Credit=5.

When a player account is accessed responsive to insertion of the player's card, the host computer prevents the account from being accessed from another slot machine. This blocks the use of a duplicate card to load the account into a second machine after the account information has already been fetched from the host computer and loaded into a first machine. This can be accomplished in a manner similar to that used to prevent a document from being loaded into a word processor operating on two different computers on a network. In other words, after the document is loaded, it is locked out from being loaded into a second word processor on the network.

In steps 2 and 3, the player places a wager, for example, in the amount of $0.15 via the coin acceptor and presses spin button 53 to play the game. If the player deposits coins or bills, via bill acceptor 68, in excess of the amount wagered, the balance appears on credit meter 70. But in the present example, assume that the wager is made via the coin acceptor and that there is a zero balance on the credit meter after the wager is applied to coin-in meter 72 and before the player pushes spin button 53.

When the player presses the spin button, the reels begin to spin. Also in response to pressing the spin button, coin-in meter 53 goes to zero, the account credits are debited by 3 (the amount of the wager in the number of coins applied to coin-in meter 72 ), and credit meter 70 is credited by 3—effectively restoring the player's initial wager. Display 58 now shows: Account Credit=97, credit meter 70 now shows a balance of 3, and the player has had a free game.

It should be appreciated that the credit applied to the meter after the reels spin, could be in amounts other than a one-to-one ratio. That is, instead of matching each credit bet with a credit applied to the credit meter, the casino could choose to award, e.g., a half credit for each credit bet, or could make the award greater, e.g., two credits applied to the credit meter for each credit bet. The present embodiment, however, is described with a matching credit applied to the credit meter for each credit bet.

The player may, if he or she so chooses, redeem the meter credits by depressing cash-out button 74, or may continue to play. Assume that the player elects to wager 2 credits on the next game. The player depresses the coin-in button (not shown) to transfer 2 credits from credit meter 70 to coin-in meter 72. Credit meter 70 then shows a balance of 1 and coin-in meter displays 2. When spin button 53 is depressed to play the game, 2 more credits are deducted from the account credits and added to credit meter 70. After the game, display 58 shows: Account Credit=95. And credit meter 70 shows a balance of 3, 1 credit remaining from before the game and 2 added from the account credits responsive to the play.

Assume this game resulted in a 10 coin win based on the pay table in EGM 12. This win is applied to credit meter 10, which now shows a balance of 13. The player may again decide to cash out and thus retrieve the 10 coin win and the initial 3 coin investment. All 5 credits wagered came from the account credits, which now has a 95 credit balance.

With this system, the player must wager each account credit he or she wishes to cash out. In other words, the player cannot cash out the account credits without wagering them. All awards, whether from jackpots or bonuses, are applied to credit meter 70. When the player finishes wagering, he or she cashes out and removes his or her card. When the player wishes to resume wagering, on EGM 12 or on any other of the EGM's connected to the network of FIG. 1, the card is again inserted into the card reader, like reader 66, associated with the EGM played by the player. The display shows: Account Credit=95. And the player must again use their own money, recovered from cashing out at the last machine, to initiate the wagers.

Account credits can be applied by the casino to a players account as a player-tracking sign-up award, as in the example above. In addition, the casino might credit the account for a special date such as a birthday, an anniversary, etc., and send mail to the player notifying him or her of this credit.

Another promotion is described in the '125 patent and is referred to therein as Welcome Back In that promotion, a player who earns a predetermined minimum number of account points has their account credited for half-priced wagering as described in the '125 patent. This encourages the player to return to the casino at a later time. This award could be made in account credits that are redeemed as described in the present application. The present invention is an expansion of this concept to drive players to not only return to the casino but to return at specific times.

Similarly, any of the bonus awards described in the '882 patent or in the '125 patent could be made in account credits rather than being applied directly to the credit meter. For example, some random awards are funded by placing a preselected percentage of wagers made into a bonus pool. The wagers may be made either on a preselected group of machines or by a single identified, player playing on different machines. The group is preselected by the casino at workstation 40 with the host computer accounting for the bonus pool for that group, as well as other groups of machines. Such a preselected group is referred to as a link. After a minimum amount is accrued in the bonus pool, the pool, or a portion thereof, is awarded at random to an eligible player. Such awards, rather than being paid to the credit meter, could be in the form of account credits that must be redeemed as described above.

Another bonus award that could be made in account credits occurs when a big win is won. For example, assume that one of the slot machines pays a large amount, defined by the casino as being over a predetermined amount. This big win could be a result of a jackpot, dictated by the machine's pay table, or as a result of one of the random or other bonuses that does not result from the machines pay table.

When a big win occurs, all the same machines on the link (or all the machines on the network) can be paid a bonus, either in the form of a credit to the credit meter or as account credits or points. Such a bonus can be programmed at the host computer to occur responsive to the big win. The casino can impose eligibility criteria for awarding this bonus, such as a predetermined rate or level of play. In addition, the casino can also condition that such bonuses be paid only to carded players as a further incentive to enroll players in the player-tracking system. On the other hand, awards could still be made to uncarded players but carded players could give larger awards, also as an incentive to register for and use a player-tracking card. The big-win award is made to all of the players on the link by crediting the RAM in each MCI 50 on the link with a predetermined amount of account credit. Uncarded players therefore receive the same credit as a carded player. The uncarded player must, however, use all of the account credits on the machine to which the award is made. Thus, applying credit to a player's account may be done manually by the casino at a keyboard when, e.g., the player signs up for carded play. This credit is applied to the player's account on the host computer. As described above, the credit may also be applied to either a carded or uncarded player by awarding account credits over the network directly to the RAM in MCI 50 in the player's EGM.

The big-win award could be in a predetermined amount of money (in account credits) or as a multiple of the player's last wager. Alternatively, the award could be in account credits, e.g., 5 credits. A player on a $1 machine would get a $5 account credit and a player on a quarter machine would receive a $1.25 account credit.

Finally, big-win awards have an expiration time. If button 62 is not pressed within a predetermined number of seconds after the award is made, it expires and will not be granted. This prevents a nonplayer from collecting an award at a machine that a player has just walked away from. Display 58 coupled with audible signals from speaker 64 clearly indicates to the player the need to press button 62 to collect the prize.

Another important feature of the present invention involves the accumulation of earned credits and the conversion of earned credits to redeemed credits at the slot machine and without involvement of casino personnel. The following Table 2, which is described in more detail below, sets forth the sequence followed by the player to convert account points to account credit at EGM 12.

TABLE 2

| | |
|---|---|
| 1. | Player account information, including earned credits and points, is stored in MCI 50 RAM responsive to insertion of card 66 into reader 60. |
| 2. | Display 58 displays account points and player accumulates additional earned credits from play during earn credit periods until card 66 removed from reader 60. |
| 3. | Upon insertion of card 66 into reader 60 during a redeem credit time period, all accumulated earned credits are converted to redeemed credits, which now appear on display. |
| 4. | Player places wager by inserting bill into bill acceptor 68, coin into the coin acceptor (not shown), or uses credits available from credit meter 70. |
| 5. | Player plays game by pushing spin button 53. |
| 6. | Responsive to play, the redeemed credits are automatically debited in the amount of the wager and applied to credit meter 70. |
| 7. | Steps 5 and 6 are repeated so long as the player wishes to play. |
| 8. | When the player is finished playing, he or she pushes cash-out button 74 and withdraws card 66 from reader 60. |

When the player inserts card 66 into reader 60, the account information is fetched from the host computer in step 1 above. In step 2, the amount of earned credits accrued appears on display 58. In the present example, assume the casino awards one earned credit for every $0.01 wagered during the earning time period specified within the configuration workstation 40. A player having wagered $50 has consequently accrued 5,000 earned credits, which is the number appearing on display 58. Further play during this or another earning time period within the bonus period results in accumulation of additional earned credits.

The preferred implementation of the invention operates to award players bonuses for reaching certain playing milestones. Accordingly, one award would be given for betting $100 and another $200, with the player receiving prompt messages to induce the player to play enough to reach the next bonus level.

In step 3, the player has returned to the gaming machine at a later time during which a redemption time period is active and inserts his card 66 into reader 60, thereby converting his or her earned credits to redeemed credits. Redeemed credits are converted for use on the particular gaming machine. Assuming the EGM is a dollar machine, display 58 consequently shows the number of redeemed credits available for play on the dollar machine to be 50.

Steps 4 through 8 occur in the same manner as described for steps 2 through 6 in the example associated with Table 1. In other words, redeemed credits are debited after each play in the amount of the wager with that amount being also credited on the credit meter. All awards, whether from jackpots or bonuses, are applied to the credit meter.

In step 8, when the player is finished playing, he or she may cash out any amount on credit meter 70 by pushing cash-out button 74 and withdraw card 66 from reader 60. When the player next inserts the card into one of the card readers on the network, the balance in credits appears in display 58.

Unused redeemed credits are always stored as points when the player logs out. For example, assume the player has 5,000 points and converts them to 50 account credits. The player then plays down to 42 account credits and when he or she logs out, the account balance shows 4,200 points. On the other hand, if the player converts the 5,000 points to 50 account credits and then receives a big-win prize of 20 account credits, the player's balance is 70 account credits: 50 converted from points, and 20 awarded. If the player logs out after only nine of the account credits are used, the system stores 5,000 account points and 11 account credits in the player's account. When the player next logs on to a machine, the number of account points—5,000—are displayed, and the display then changes to Account credit=11. These credits are used as play proceeds.

In another example, assume the player converts 5,000 points into 50 account credits and plays 8 of the account credits. If an award of 20 account credits is then made, the display indicates 62 account credits, and play continues. If the player then plays down an additional five credits, then logs out, the account has 4,200 points and 15 account credits, the account credits being displayed the next time the player logs in.

The activity described in the preceding examples takes place at the MCI 50 and associated RAM after the player's account information is retrieved from the host computer. When the player logs out, any remaining points or account credits are again stored in the account on the host computer.

With this system, credits are redeemed for additional gaming rather than for merchandise, meals, or the like. The casino would prefer to be providing gaming to players rather than maintaining and dispensing an inventory of noncash items. In addition, the present system prevents a break in gaming. Rather than the player waiting in line to redeem points, the player is on the floor playing the games, which again enables the casino to continue to provide gaming to the player. The player also has the flexibility of converting back and forth between account credits and account points, as he or she chooses. Because the points are converted to account credits rather than to credits on the gaming meter, the player can redeem the credits one wager at a time, i.e., they can not be cashed out at once.

In all embodiments disclosed herein, any jackpots or bonuses won are applied to the credit meter, which the player can cash out or wager as he or she sees fit. In addition, account credits can be applied either at the host computer or locally over the network. The account credits may be applied either manually, responsive to input by casino personnel at a keyboard, or in response to bonus rules that are programmed on the host computer. Finally, it is a significant advantage that this system is implemented with the player tracking card, because many players already have and use one.

Scheduled Return Play

Figure 3:
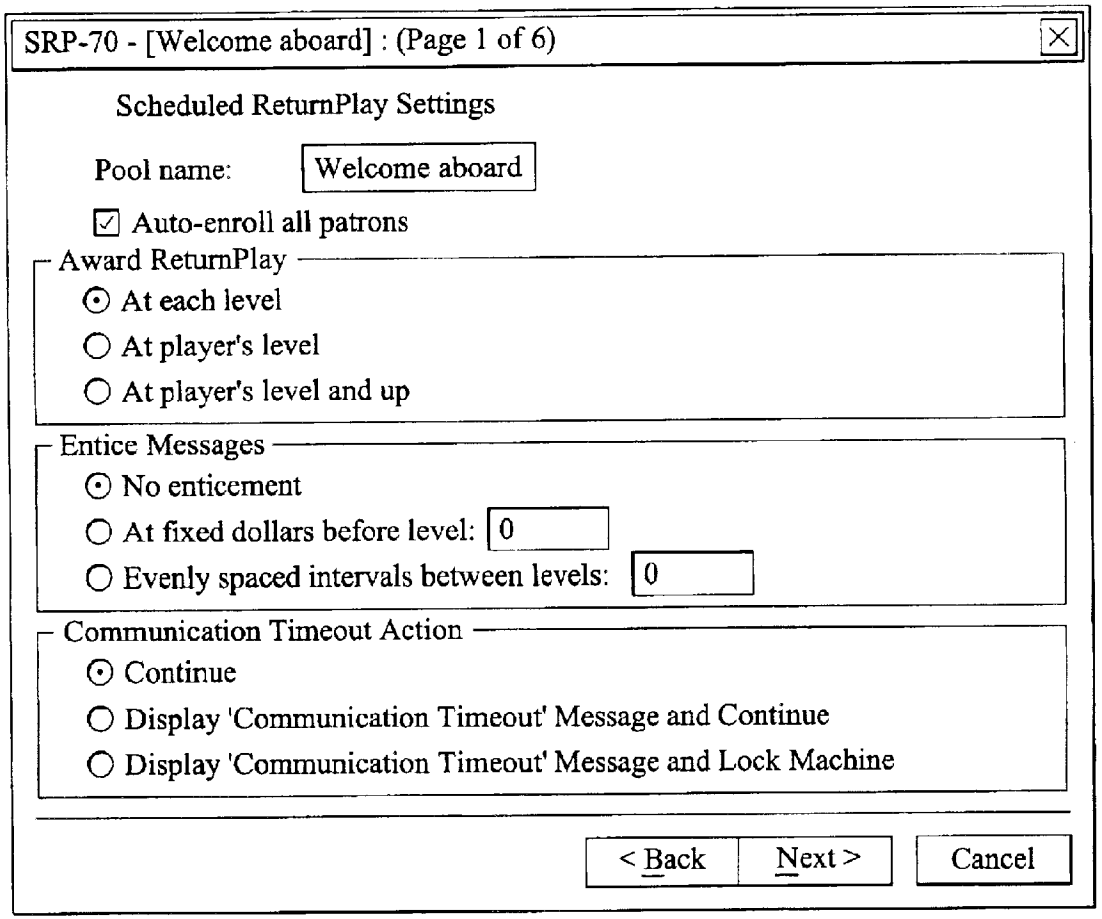
FIGS. 3–12 are screen shots illustrating bonus promotion criteria selected within configuration software operating on the network of FIG. 1.

Described below is a method for implementing the bonus according to a preferred embodiment of the invention. FIG. 3 illustrates a screen shot of a program operating on the configuration workstation 40 that allows a casino operator to designate operating criteria of the incentive bonus described herein. A description of the operating parameters shown in FIG. 3 is shown in Table 3 below and incorporates the concept of award by player level:

TABLE 3

Scheduled ReturnPlay Main Settings Fields [FIG. 3]

| Field Name | Description |
|---|---|
| Pool Name | Return play promotion pool name. |
| Auto-enroll all patrons | If selected, all patrons are eligible for the promotion. If not selected, patron eligibility is determined by information within player server 42. |
| Award at each level | A player is awarded ReturnPlay for each level they reach. For example, if there was play to the level 5 threshold, the player would get the award for levels 1, 2, 3, 4, and 5. |
| Award at player's level | This is a status symbol version where higher level players are not bothered with smaller awards. For example, a level 5 player would only receive an award when they play to the level 5 threshold. |
| Award at player's level and up | This is a status symbol version where higher level players are not bothered with smaller awards. For example, a level 5 player would receive an award when they play to the level 5 threshold or above. |
| No enticement | No messages are displayed to entice the player to the next tier. |
| At fixed dollars before level | Enables an enticement message at a dollar value before the next level. For example, as a player approaches the threshold for tier 2, the player receives a message "$10.00 play to go before $$$$ reward". The amount before the next level is specified in the edit box. See the examples in section Error! Reference source not found . . . |
| Evenly spaced intervals between levels | Enables an enticement message at intervals between levels. For example, if there are $100 between tiers 2 and 3, the player could receive an enticement message at $75, $50, and $25 left to play. The number of entice messages between levels is specified in the edit box. See the examples in section Error! Reference source not found . . . |
| Continue | If the bonus server is offline, play continues with no VFD message display. |
| Display "Communication Timeout Action" and Continue | If the bonus server is offline, display the appropriate VFD message and continue play. |
| Display "Communication Timeout" action and Lock Machine | If the bonus server is offline, display the appropriate VFD message and lock machine so further play cannot be continued. |

Players can be grouped by level to signify, for instance, how valued a player is to the gaming casino. The player level can determined based upon one or more of the following criteria: theoretical win, frequency of visit, time since last visit, amount played per visit, home address, age, sex, average bet amount, and type of game played. Alternately, of course, the casino operator can simply assign a number (e.g. between 1 and 10) within the proper location of the player account record to indicate the player level. As will be appreciated, the gaming machine on which the player plays can be operated responsive to the player level. For instance, the machine can be operated by MCI 50 to display a selected one of certain messages stored in VFD 58 to the player responsive to play on the gaming device and to the player level. Thus, two players, each having a different level from the other, would have displayed to them a different message for identical levels of play. Alternately, the machine can be operated by MCI 50 to award to the player an award based on the player level of the player where the award would be different than one awarded to a different player having a different player level. For instance, lucky coin pools would be determined by player levels and grouping. Also, personal progressive parameters such as minimum and maximum prize amount, increment rate, etc. would be determined by player level or group.

Player grouping is analogous to machine groups. Players can be divided into groups based on historical behavior, demographic characteristics, and personal interests. Bonus eligibility and functionality parameters can be modified based on what groups players fall into. The thought is that bonuses can be tailored to be appealing to each group. Upon player card insertion, the group information is retrieved from the database. The MCI 50 then determines eligibility for bonuses based on group information, and adjusts bonus parameters accordingly. Examples of bonus tables constructed to award players different amounts based on levels are illustrated below.

Figure 4:
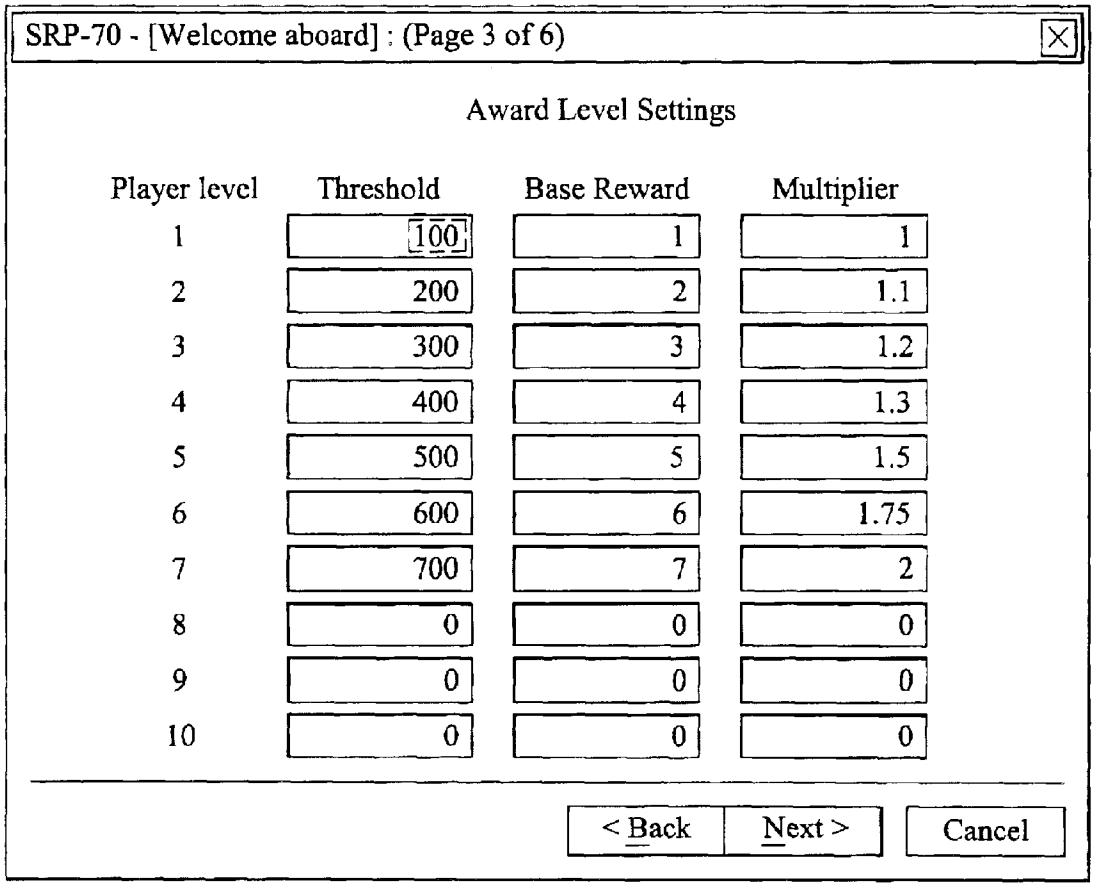

FIG. 4 is a screen shot illustrating the levels where awards are earned, and any multiplier applied to a player's earnings. This table will be used in the examples described further below. A description of the operating parameters shown in FIG. 4 is shown in the table below:

TABLE 4

Award Level Settings Fields [FIG. 4]

| Field Name | Description |
|---|---|
| Player level | Maximum ten player levels. |
| Threshold | Amount of play for required award eligibility. |
| Base Reward | The minimum dollar amount given to a player. |
| Multiplier | A discretionary multiplier applied to the base award for player incentive (earned credit multiplier) |

Any awards given to a player are typically cumulative. For example, using the award level settings illustrated in FIG. 4, if a player receives an award for level 1 and level 2, that player would receive a total earned credit amount of $3 ($1 for level 1 and $2 for level 2). The section below illustrates examples of different game settings (FIG. 3) and how such settings affect play.

The scenarios described below all use the exemplary award level settings shown within FIG. 4. That is:

| Level | Threshold | Base Award | Multiplier |
|---|---|---|---|
| 1 | 100 | 1 | 1.00 |
| 2 | 200 | 2 | 1.10 |
| 3 | 300 | 3 | 1.20 |
| 4 | 400 | 4 | 1.30 |
| 5 | 500 | 5 | 1.50 |
| 6 | 600 | 6 | 1.75 |
| 7 | 700 | 7 | 2.00 |

Each example below includes a table with the amount played and the amount to be awarded to a player at a specific level. The player's level is retrieved from the player server database 42 when the player's card is inserted.

EXAMPLE 1

(Award at Each Level)

With this type of ReturnPlay bonus selected, the base award for the total amount of play is the amount earned regardless of the level of the player. The following bonus payout award table results from selecting the award "At each level" option in the Scheduled ReturnPlay Main Settings screen (FIG. 3) and using the award level settings shown above and in FIG. 4.

| Amount Played | Level 1 Award | Level 2 Award | Level 3 Award | Level 4 Award | Level 5 Award | Level 6 Award | Level 7 Award |
|---|---|---|---|---|---|---|---|
| $100 | $ 1.00 | $ 1.10 | $ 1.20 | $ 1.30 | $ 1.50 | $ 1.75 | $ 2.00 |
| $200 | $ 3.00 | $ 3.30 | $ 3.60 | $ 3.90 | $ 4.50 | $ 5.25 | $ 6.00 |
| $300 | $ 6.00 | $ 6.60 | $ 7.20 | $ 7.80 | $ 9.00 | $10.50 | $12.00 |
| $400 | $10.00 | $11.00 | $12.00 | $13.00 | $15.00 | $17.50 | $20.00 |
| $500 | $15.00 | $16.50 | $18.00 | $19.50 | $22.50 | $26.25 | $30.00 |
| $600 | $21.00 | $23.10 | $25.20 | $27.30 | $31.50 | $36.75 | $42.00 |
| $700 | $28.00 | $30.80 | $33.60 | $36.40 | $42.00 | $49.00 | $56.00 |

The advantages of the Award at Each Level scheme is that it is simple to explain to customer, is simple to calculate, that it rewards customer for additional play, that everyone starts at the same level, and that it can award preferred (higher level) patrons more. Note how higher level players achieve a greater earned credit award from lower players with the same level of play. A level 1 player that plays $400 would earn a $10.00 earned credit award; while a level 5 player would earn a $15.00 award from the same amount of play owning to the earned credit multiplier of ×1.5 set in the award level settings screen of FIG. 4. By setting the multiplier for all levels to 1, however, all players would be awarded the same amount (the Level 1 Award amount).

EXAMPLE 2

(Award at Player's Level)

With this type of ReturnPlay bonus selected, players have to play to their normal play level to earn an award. Additional play does not earn any additional credit. That is, higher level players might be expected to gamble more money and thus would be awarded only upon reaching higher thresholds than lower level players. The following bonus payout award table results from selecting the award "At player's level" option in the Scheduled ReturnPlay Main Settings screen (FIG. 3) and using the award level settings shown above and in FIG. 4

| Amount Played | Level 1 Award | Level 2 Award | Level 3 Award | Level 4 Award | Level 5 Award | Level 6 Award | Level 7 Award |
|---|---|---|---|---|---|---|---|
| $100 | $1.00 | $0.00 | $0.00 | $ 0.00 | $ 0.00 | $ 0.00 | $ 0.00 |
| $200 | $1.00 | $3.30 | $0.00 | $ 0.00 | $ 0.00 | $ 0.00 | $ 0.00 |
| $300 | $1.00 | $3.30 | $7.20 | $ 0.00 | $ 0.00 | $ 0.00 | $ 0.00 |
| $400 | $1.00 | $3.30 | $7.20 | $13.00 | $ 0.00 | $ 0.00 | $ 0.00 |
| $500 | $1.00 | $3.30 | $7.20 | $13.00 | $22.50 | $ 0.00 | $ 0.00 |
| $600 | $1.00 | $3.30 | $7.20 | $13.00 | $22.50 | $36.75 | $ 0.00 |
| $700 | $1.00 | $3.30 | $7.20 | $13.00 | $22.50 | $36.75 | $56.00 |

Suppose, for example, that a level 1 player, a level 4 player, and a level 5 player each gamble $400. Earned credits accumulated within the MCI 50 of the EGM 12 for the level 1 player would result in only a $1 award. This award would be transferred to the player server 40 as, $1 in earned credits (stored as 100 cents) upon removal of player card 66 from the card reader 60 at EGM 12 and stored within the player account. Earned credits are converted to playable redeemed credits by returning the casino at a later time during a redemption period according to the process described further below. The level 1 player would receive only $1 in earned credits since, after passing the $100 threshold for play on the gaming machine, no additional earned credits are awarded for passing other thresholds.

The level 4 player would receive $13.00 in earned credit bonus for playing $400, calculated as base (level 1) award of 10 base credits from FIG. 3 (1+2+3+4) multiplied by the earned credit multiplier ×1.3.

The level 5 player would receive $0.00 since the player had not yet achieved the $500 threshold at which earned credits are awarded. As play is tracked during earning play periods, the player could return at a later earning play period time and play $100 more to earn the $22.50 earned credit bonus award, calculated as base (level 1) award of 15 base credits from FIG. 3 (1+2+3+4+5) multiplied by the earned credit multiplier ×1.5.

Once the "At player's level" earned credit bonus is awarded, the player has no incentive to play further and must redeem the earned credits before accumulating more.

EXAMPLE 3

(Award at Player's Level and Up)

With this type of ReturnPlay bonus selected, players have to play to their normal play level to earn an award but will continue to accumulate awards with additional play. Unlike the award scheme described in Example 2, therefore, additional play does earn any additional credit. The following bonus payout award table results from selecting the award "At player's level" option in the Scheduled ReturnPlay Main Settings screen (FIG. 3) and using the award level settings shown above and in FIG. 4

| Amount Played | Level 1 Award | Level 2 Award | Level 3 Award | Level 4 Award | Level 5 Award | Level 6 Award | Level 7 Award |
|---|---|---|---|---|---|---|---|
| $100 | $ 1.00 | $ 0.00 | $ 0.00 | $ 0.00 | $ 0.00 | $ 0.00 | $ 0.00 |
| $200 | $ 3.00 | $ 3.30 | $ 0.00 | $ 0.00 | $ 0.00 | $ 0.00 | $ 0.00 |
| $300 | $ 6.00 | $ 6.60 | $ 7.20 | $ 0.00 | $ 0.00 | $ 0.00 | $ 0.00 |
| $400 | $10.00 | $11.00 | $12.00 | $13.00 | $ 0.00 | $ 0.00 | $ 0.00 |
| $500 | $15.00 | $16.50 | $18.00 | $19.50 | $22.50 | $ 0.00 | $ 0.00 |
| $600 | $21.00 | $23.10 | $25.20 | $27.30 | $31.50 | $36.75 | $ 0.00 |
| $700 | $28.00 | $30.80 | $33.60 | $36.40 | $42.00 | $49.00 | $56.00 |

As with Example 2, suppose that a level 1 player, a level 3 player, and a level 5 player each gamble $400. Earned credits accumulated within the MCI 50 of the EGM 12 for the level 1 player would result in a $10 award (versus only $1 award with "At Player Level" setting). This award would be transferred to the player server 40 as $10 in earned credits (stored as 1000 cents) upon removal of player card 66 from the card reader 60 at EGM 12 and stored within the player account. Earned credits are converted to playable redeemed credits by returning the casino at a later time during a redemption period according to the process described further below. The level 1 player would receive $10 in earned credits since, after passing the $100 threshold for play on the gaming machine, additional earned credits are awarded for passing other thresholds. Note that awards for level 1 players is identical as in Example 1.

The level 3 player would receive $12.00 in earned credit bonus for playing $400, calculated as base (level 1) award of 10 base credits from FIG. 3 (1+2+3+4) multiplied by the earned credit multiplier ×1.2.

The level 5 player would receive $0.00 for only playing $400 since the player had not yet achieved the $500 threshold at which earned credits are awarded. As play is tracked during earning play periods within the same bonus pool, the player could return at a later earning play period time and play $100 more to earn the $22.50 earned credit bonus award, calculated as base (level 1) award of 15 base credits from FIG. 3 (1+2+3+4+5) multiplied by the earned credit multiplier ×1.5.

Once the "At player's lever" earned credit bonus is awarded, the player still has incentive to play further while preferred patrons are awarded more. By setting the earned credit multiplier for all levels to 1, all players would be awarded the same amount once they reached their normal level of play. That is, the level 1 and 3 players would each be awarded $10.00 in earned credits for playing $400. The level 5 player, not having reached the $500 "normal level of play," would receive $0.00.

An optional, yet important, part of the bonusing scheme of the present invention is the idea of Enticement. There are three entice choices listed in FIG. 3 labeled under as "Entice Messages" selections. The first selection is for "no enticement", meaning that no messages are displayed on the VFD 58 relating to the amount of play remaining until the next threshold is reached.

The second selection will cause the MCI 50 to track the cumulative amount bet by the player and issue a command to the VFD 58 to display an enticement message when the tracked cumulative amount bet approaches the next threshold to be reached by the player. A box within FIG. 3 allows a casino operator to configure the bonus to set the value below the next threshold at which the enticement message is displayed. For example, if the enticement is set at $20 before a level and the player has currently played $150, the message will display when player plays $180. If, as in Example 3 above, a level 5 player has played $150, the message will display when the player plays $480 because no ReturnPlay bonus will occur, and no earned credits awarded, until the level 5 player reaches $500.

Finally, the third selection causes the enticement message to be played multiple times between thresholds at even intervals. The number of intervals is determined by the number entered into the box provided in the configuration program screen shown in FIG. 3. For example, if the enticement message is set to occur three times between levels such as those of $100 multiples set in FIG. 4, the message would be displayed at $25, $50 and $75 after each threshold. If the enticement message is set to occur 1 time, then the MCI 50 would only trigger an enticement message at the VFD 58 at $50 after each threshold (e.g. at $50, $150, $250, etc.).

Figure 5:
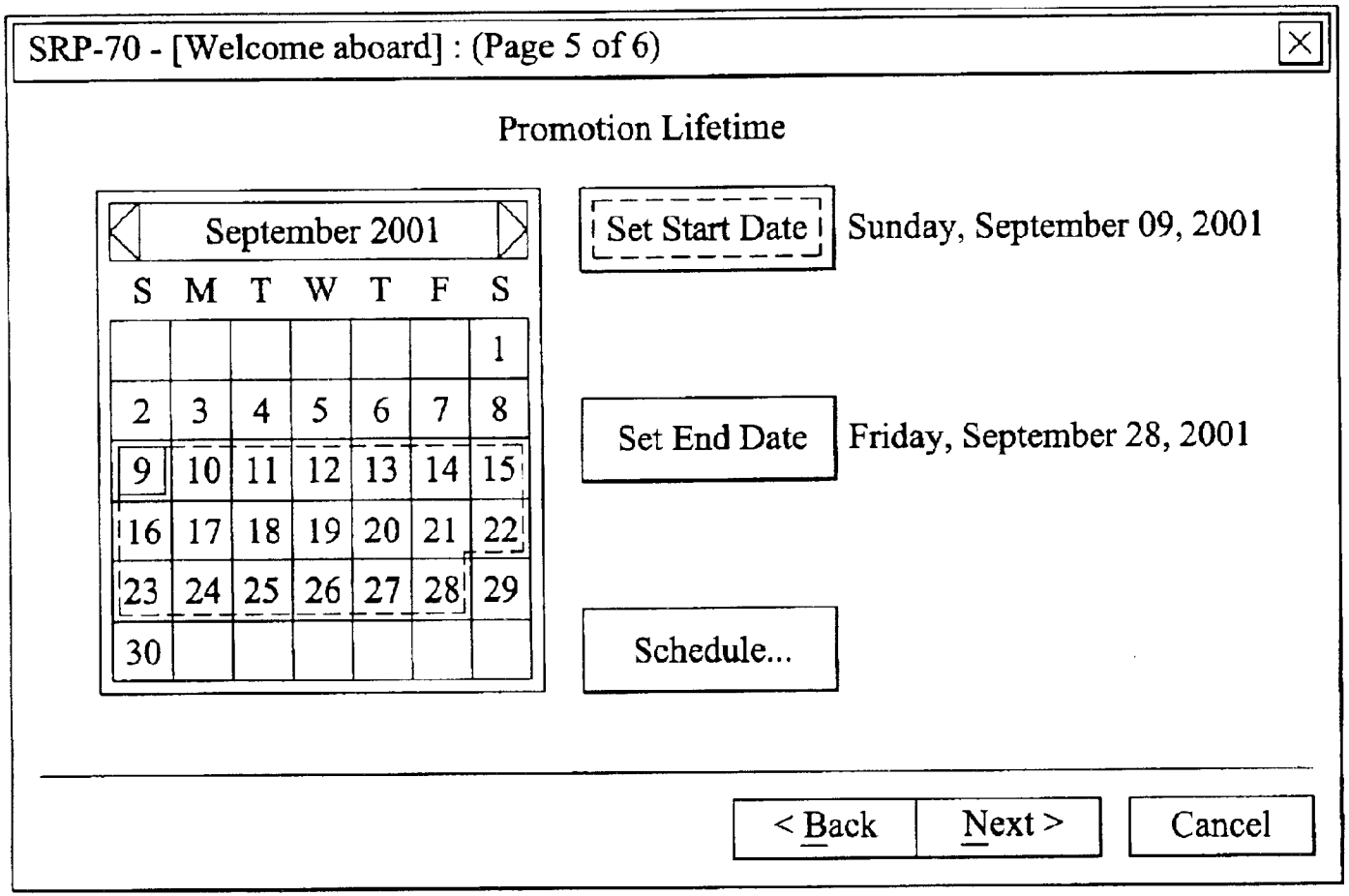

A major component of the Schedule ReturnPlay bonus operated according to a preferred embodiment of the invention is the ability to schedule when ReturnPlay credits are earned ("earned credits") and when they are redeemed ("redeemed credits"). FIG. 5 illustrates another screen of the configuration program used to designate criteria of the bonus, specifically the start and end dates for the promotion identified by the pool name listed in FIG. 3.

TABLE 5

Scheduled Return Play Scheduling Fields [FIG. 5]

| Field Name | Description |
|---|---|
| Monthly Calendar Display | Fully functional presentational calendar. |
| Set Start Date | ReturnPlay promotion start date. |
| Set End Date | ReturnPlay promotion end date. |
| Schedule . . . | Opens daily schedule for earning and redeeming time periods |

To set the start date of the pool promotion (named "Welcome aboard" in FIG. 3), the operator positions the computer cursor of the configuration workstation 40 over the day of the month and depresses the mouse button. In FIG. 5, the box around Sep. 9, 2001 is highlighted once selected on the calendar. The operator sets this as the start date of the bonus pool promotion by selecting the "Set Start Date" button displayed on the configuration workstation monitor. The selected start date (Sunday, Sep. 09, 2001) then appears next to the button to indicate the promotion start date.

A similar procedure is used to select the end date of the pool promotion. The computer cursor is positioned over a selected day on the calendar and the mouse button depressed to select that day. The "Set End Date" button is then depressed to confirm the selection (Friday, Sep. 28, 2001).

Figure 6:
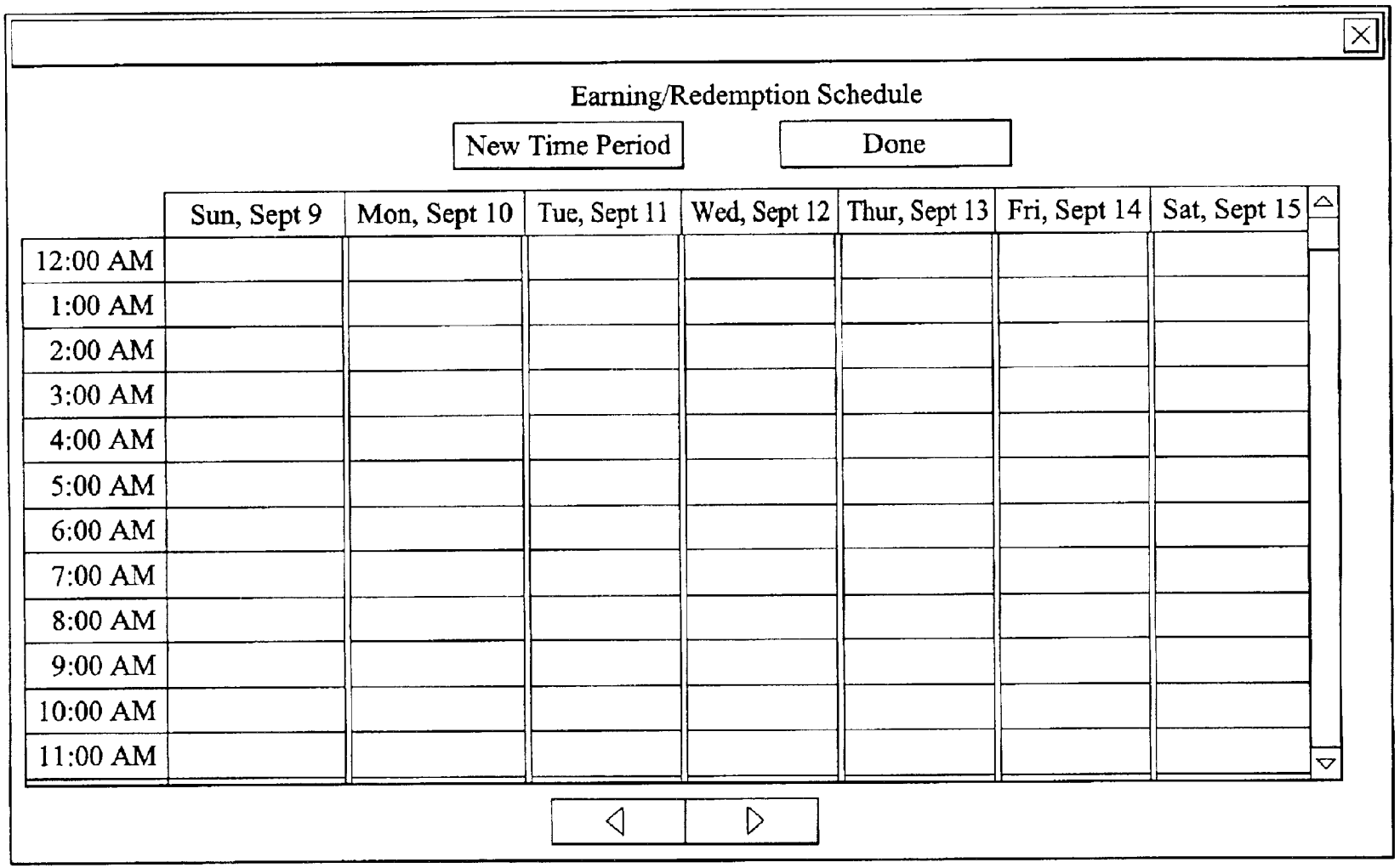
Figure 7:
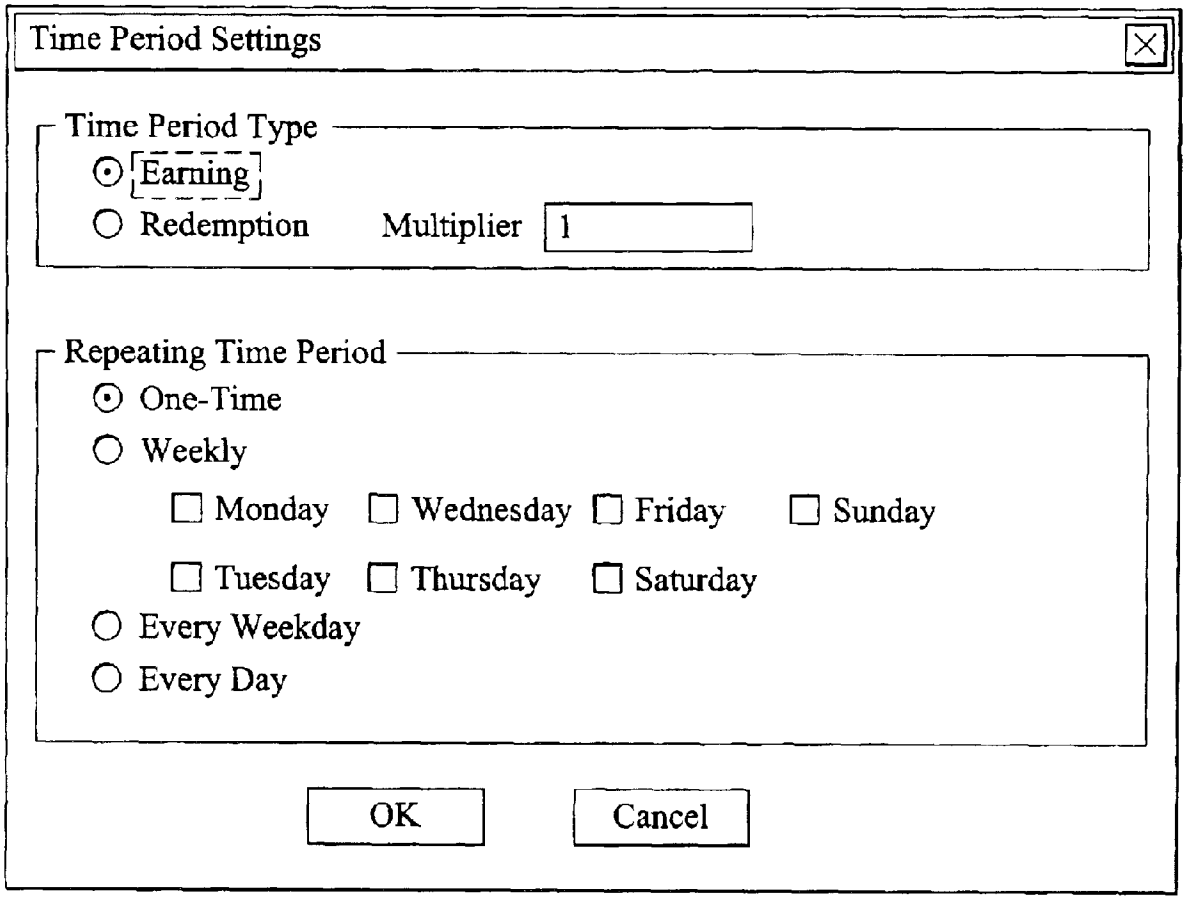

Once the start and end dates have been set, the operator clicks on the "Schedule" button to bring up the earning/ redemption schedule shown in FIG. 6. The screen shown in FIG. 6 defines the time periods when ReturnPlay credit can be earned or redeemed. A time period is defined by selecting the times on the schedule and pressing "New Time Period". This brings up a dialog to define the type of time period and any repeated occurrences as shown in FIG. 7. ReturnPlay credit can only be earned during an earning period, or redeemed during a redemption period. Redemption periods can increase the base award by a redemption multiplier value, as an incentive to players who return at off-peak hours.

TABLE 6

Scheduled ReturnPlay Scheduling Fields [FIG. 7]

| Field Name | Description |
|---|---|
| | Time Period Type |
| Earning | Time period type within ReturnPlay. |
| Redemption | Time period type within ReturnPlay. |
| Multiplier | For redemption purposes, the base reward redemption multiplier incentive, if any. |
| | Repeating Time Period |
| One-Time | One time bonus earning/redemption time period configuration. |
| Weekly | Period within the applicable week during the promotion for earning/redemptions. |
| Every Weekday | Period during the promotion for weekday earnings/redemptions only. |
| Everyday | Period during the promotion for all applicable days within the earning/redemption period. |

Figure 8:
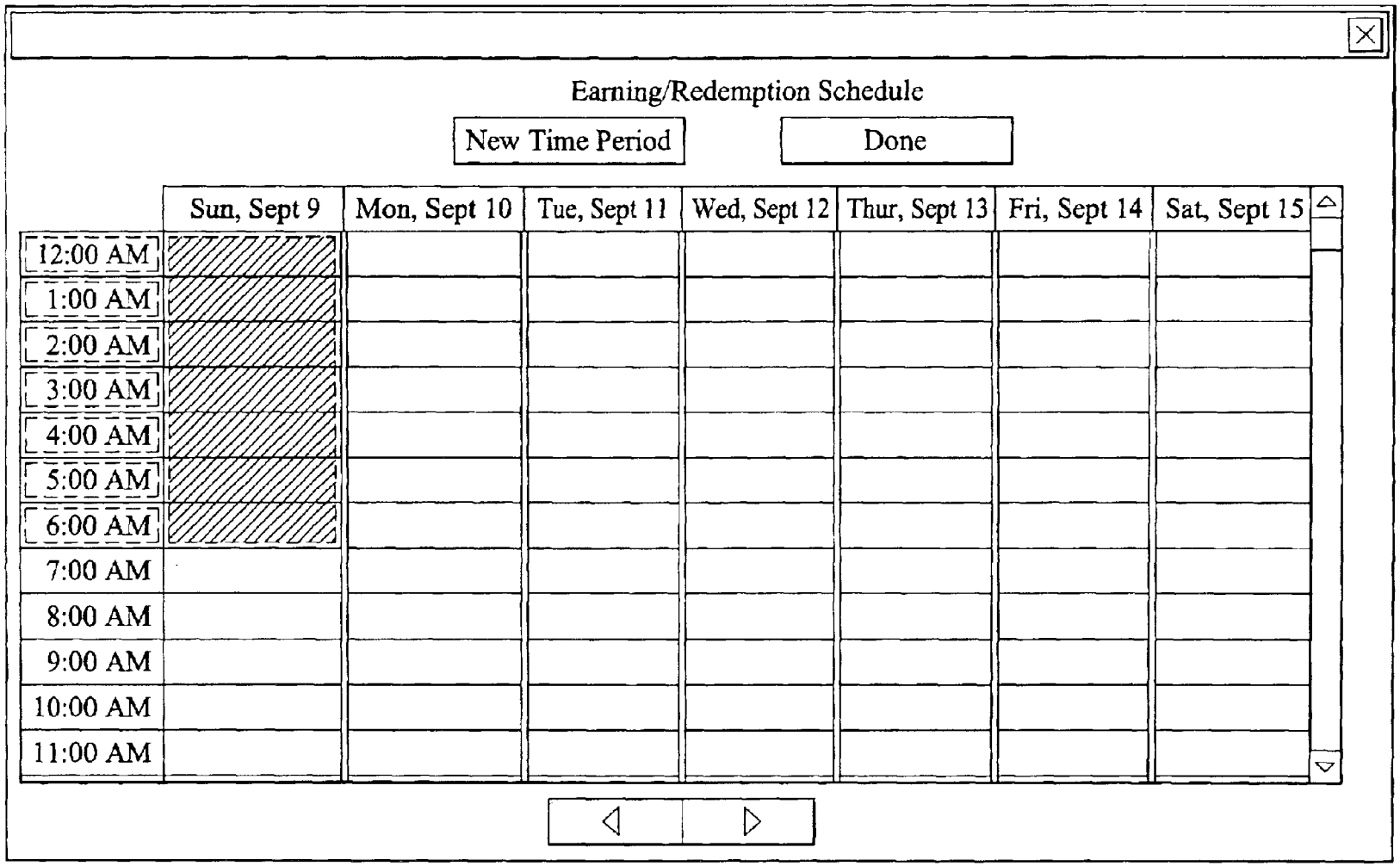
Figure 9:
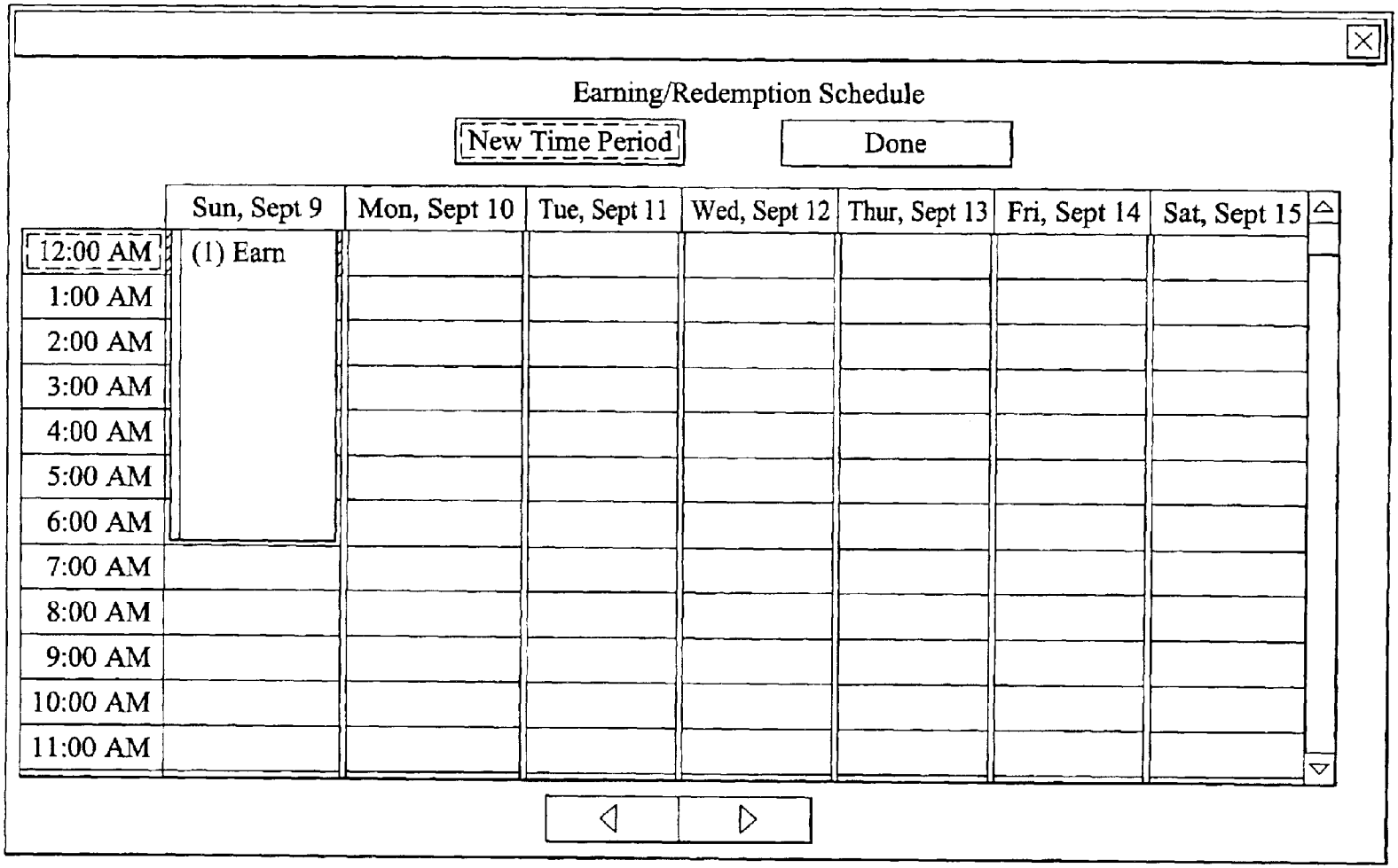

To create a Scheduled ReturnPlay time period, a range of time values is selected. For example, the screen shot shown in FIG. 8 has the time from 12:00 midnight to 7:00 AM selected. Next, the user selects "New Time Period" button to bring up the time period dialog shown in FIG. 7. The values are entered and the user selects the "Done" button to create the time period. FIG. 9 shows a One-time earning period from 12:00 midnight to 7:00 AM on Sunday Sep. 9, 2001 creating using the criteria selected in FIG. 7—that is, it is an earning period for time period selected in FIG. 8 that does not repeat throughout the week. The defined time period now shows up as an "(1) Earn" period in the graphic user interface screen to tell the operator of the configuration workstation that the period is the first one defined. Additional time periods can be defined, as long as two rules are followed:

1) The first time period defined in a promotion must be an earning period
2) The last time period defined in a promotion must be a redemption period The reason for these rules stems from the operation of the promotion according to a preferred embodiment of the invention. Each promotion pool set up in FIGS. 3 and 4 and scheduled by FIGS. 6–8 is intended to start on a certain date and end on a certain date. Credits earned during the earning periods set up on the calendar feature (FIGS. 6–8 ) can only be used during redemption periods of that pool. Beyond the end date of the pool, all credits (whether earned or redeemed) are set back to zero in the player account stored on the player server 42 whether they are used or not. Accordingly, credits must be earned before they are redeemed; and credits must be redeemed before they are used.

Figure 10:
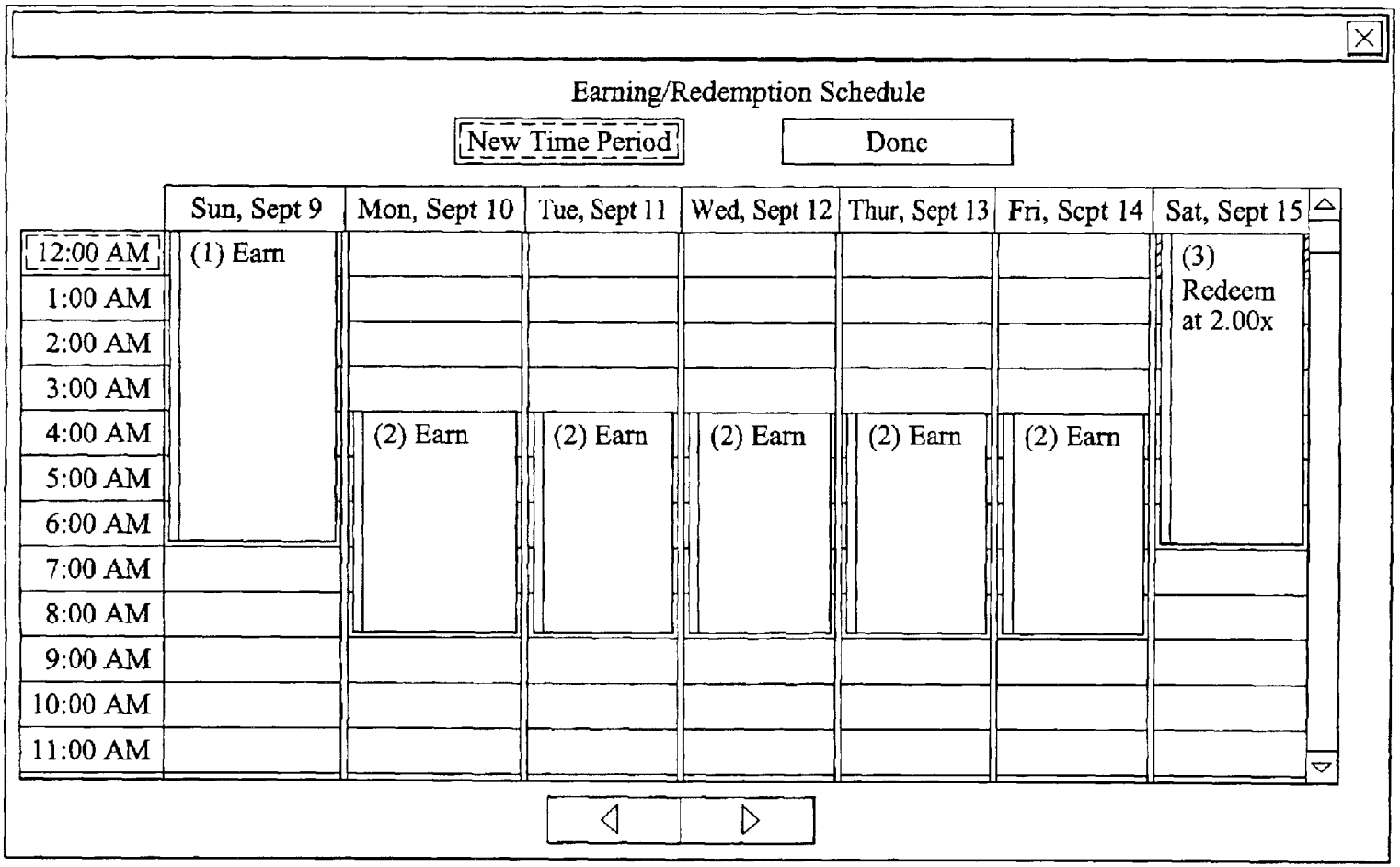

FIG. 10 shows a fully defined pool calendar having certain earn times and a redeem time. The screen shot shown in FIG. 10 does not show the full extent of the period defined on the calendar screen (FIG. 6) but it is understood that the remaining days and time periods can be shown by using the scroll down bar or using the backward-forward buttons at the bottom of the screen. Each day is shown in column format with times during the day shown by rows. The pool promotion defined includes a one-time earning period ("(1) Earn") from 12 to 7 AM, a weekday earning period ("(2) Earn") from 4 to 8 AM that operates during all weekdays during the promotion period, and a one-time redemption period ("(3) Redeem at 2.00×") with a 2× multiplier. The numbers on each schedule entry show which entries are grouped together—that is, an operator would be able to tell immediately that all 4 to 8 AM earn periods defined belong to one selection group.

Using the settings of FIG. 10 as an example, a player will continue to accumulate earned credits from Saturday through Friday (at the specified times) and then redeem those credits on Saturday at a 2× multiple. If a level 3 player, operating under a "pay at player level and above" selection, were to play $150 on Sunday between 1 and 3 AM, another $250 on Tuesday from 10 to 11 AM, and $300 on Friday from 5 to 6 AM, then the player would have accumulated a total of $450 of play during the earning time periods. The $250 played on Tuesday was outside of the earning time period and therefore would not count toward the total. From the table shown in FIG. 4 and used in Example 3 above, the level 3 player would be awarded $12.00 in earned credits and the amount stored in the player account. Note that the total play is accumulated until the player inserts his or her card into the card reader of the EGM during a redeem time.

If the player plays again on Saturday morning at 5 AM, then the card reader 60 sends the ID number read from the card to the player server 42 which then downloads the player account information (including the earned credits) into the MCI 50. The bonus server operating the pool promotion transmits through the gaming network every few seconds a data stream that is received at each MCI 50 on the network. The data stream includes configuration data regarding the promotion, including data bits identifying whether an earn period is active or a redemption period is active. The bonus server operates by comparing a clock signal to the calendar data configured within the configuration workstation 40 and stored at one or more bonus servers 42, 44. If the clock signal is within an earn period, then a data bit is broadcast during the data stream to activate the earn period flag in the MCI. Likewise, if the clock signal is within a redemption period, then a data bit is broadcast during the data stream to activate the redeem period flag. An MCI 50 receiving the player account information, noting that a redemption period is active, acts to convert the earned credits to redeemed credits by applying the redeem credit multiplier (e.g. 2×) broadcast with the data stream. The earned credits are then irrevocable converted to redeemed credits that can then be played on the gaming machine. The player with $12.00 in earned credits would have instead $24.00 of redeemed credits to play with. The earned credits meter is zeroed out and the player can then begin earning more earned credits in subsequent earning periods.

Upon removal of the player's card 66 during play will cause the number of unplayed redeemed credits to be transmitted back to the player server 42 and stored within the player account for later use.

Figure 11:
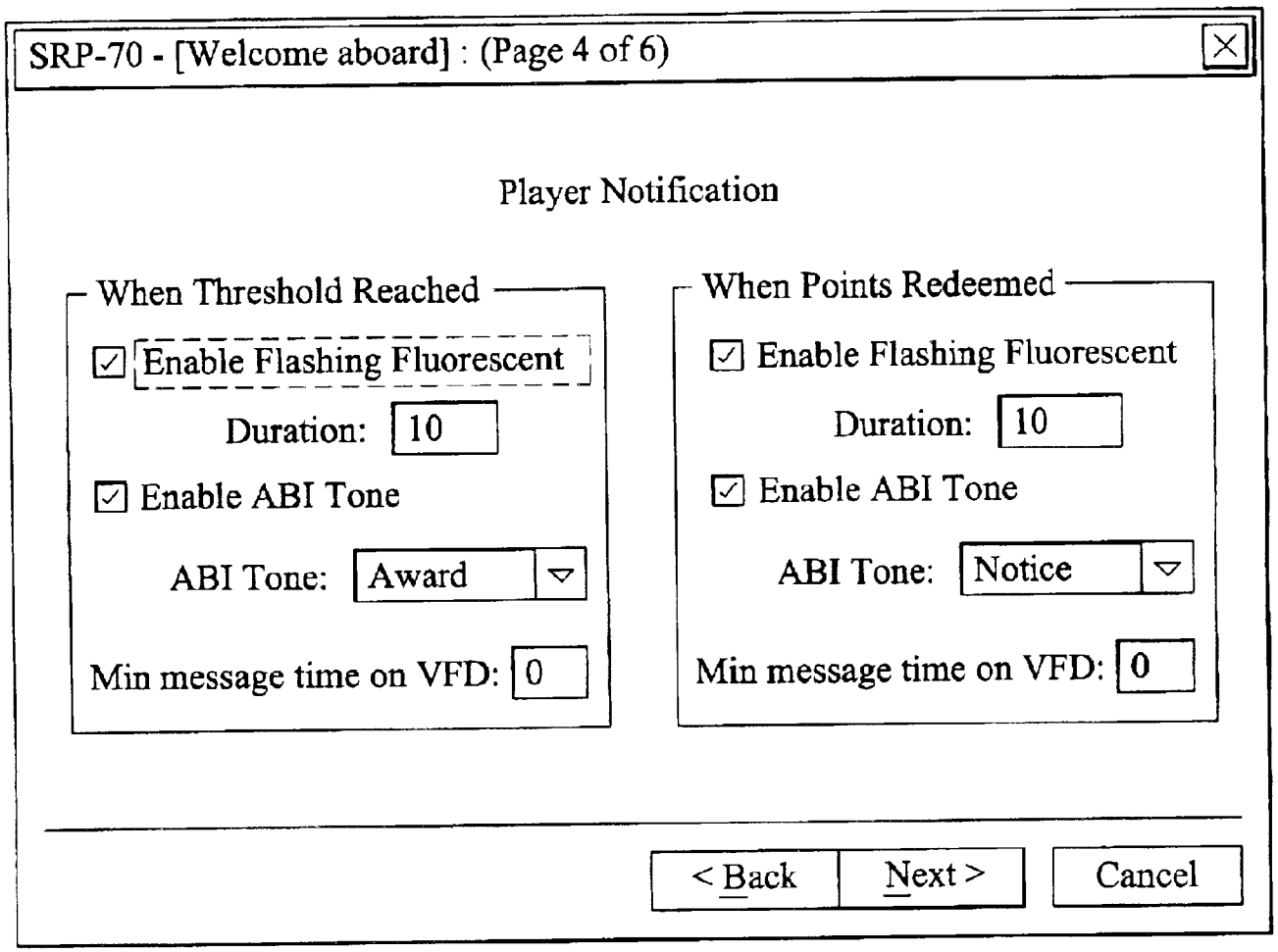

The screen shown in FIG. 11 defines what notification is given to the patron when an award is earned or redeemed. Table 7, below, defines each of the criteria shown in FIG. 11.

TABLE 7

| Field Name | Description |
|---|---|
| Player Notification Settings Fields [FIG. 11] | |
| When Threshold Reached | |
| Enable Flashing Fluorescent/ Duration | Enable/Disable flashing fluorescent display and duration in seconds. |
| Enable ABI Tone/Type Tone | Enable/Disable ABI Tone and select type tone. |
| Minimum Message Time on VFD | Minimum VFD second time. |
| When Points Redeemed | |
| Enable Flashing Fluorescent/ Duration | Enable/Disable flashing fluorescent display and duration in seconds. |
| Enable ABI Tone/Type Tone | Enable/Disable ABI Tone and select type tone. |
| Minimum Message Time on VFD | Minimum VFD second time. |

Figure 12:
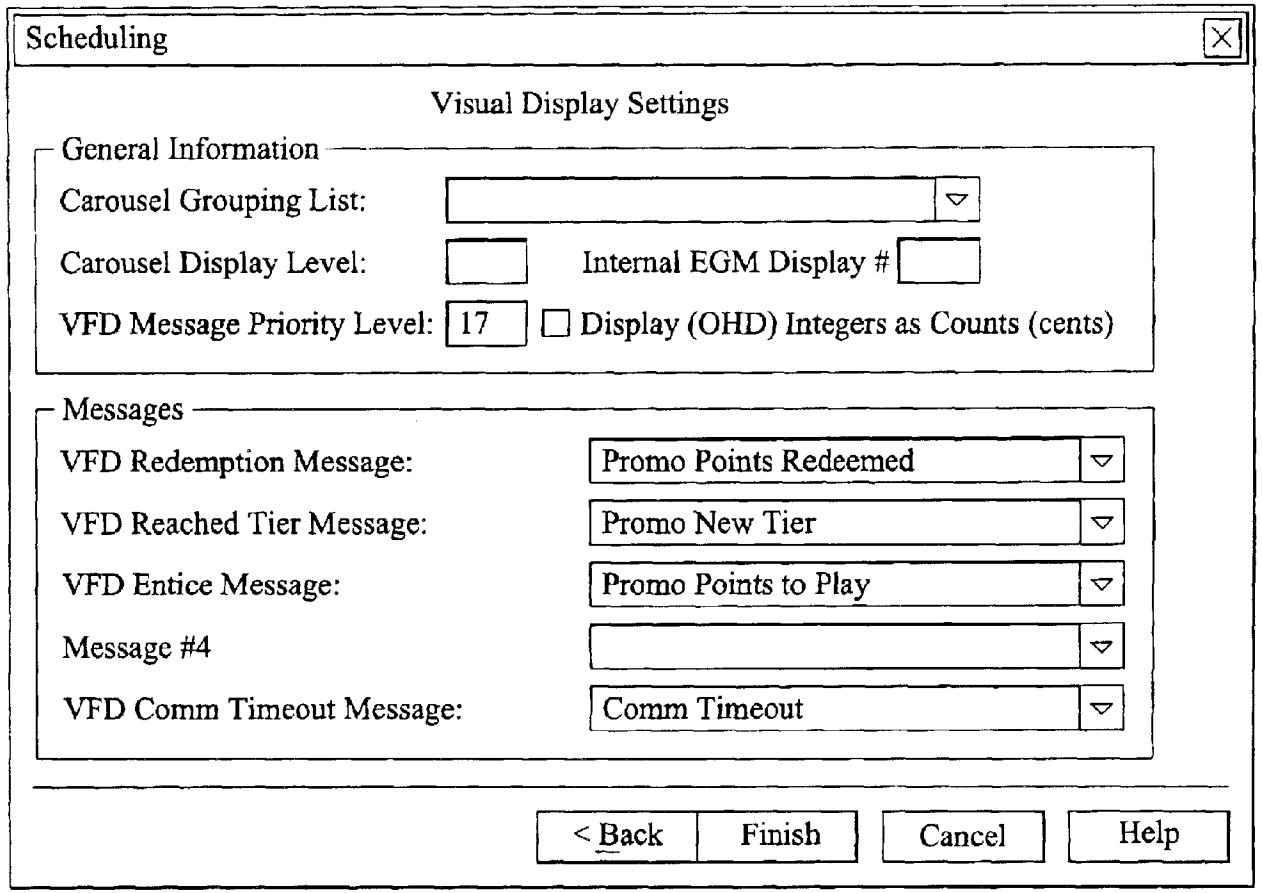

FIG. 12 illustrates the message screen configuration set by the operator. In the bonus promotion described according to the preferred embodiment of the invention described above, there are three bonus messages defined: greet a player redeeming earned credits, notify points earned and next tier attained, and enticement message noting the player level to the next tier. Confirm how the switches will be set in FIG. 12 and ensure messages match settings.

TABLE 8

| Field Name | Description |
|---|---|
| Visual Display Settings Fields [FIG. 12] | |
| General Information | |
| Carousel Grouping List | N/A |
| Carousel Display Level | N/A |
| Internal EGM # Display | N/A |
| VFD Message Priority Message | Selected priority level for controlling the order of simultaneous messages. |
| Display [OHD] Integers as Counts [cents] | N/A |
| Messages | |
| VFD Redemption Level | Message display for redemption credit availability. For example, the redemption message could contain the message such as "reward of [total reward so far] with current multiplier of [redemption multiplier] gives you [Bonus Amount]" or "Reward of $10.00 with current multiplier of 2 gives you $20.00 reward!" |
| VFD Reached Tier Message | Congratulatory message for next tier obtained. For example, "VFD Reached Tier Message" At each tier reached if enticed at each threshold and at their tier. The winning message would be something like "Congratulations, you have earned a Return Award of [total reward so far] or" "Congratulations, you have earned a Return Award of $4.00" |
| VFD Entice Message | Inform message confirming player status to next level. Depending upon configuration, a percentage incrementally notified before the reached level. For example, the Entice message could display at X % between tiers or an absolute value such as "Play [$ to next tier] more to reach next tier". |
| VFD Comm Timeout Message | Optional message if the bonus server is offline. |

Use of the redeemed credits as played credits preferably operates by one of two methods: where the redeemed credits allow a player to play a free game, and where the redeemed credits allow a player to play a half price game. Both methods are described below.

In a free game method, redeemed credits are automatically debited from the redeemed credit account stored within the MCI 50 during the redemption period. For instance, a $24.00 redeemed credit balance will allow one to play a $1 machine with a max $3 bet 8 times at max bet or 24 times at minimum bet. Once exhausted, the player's regular credits are used to play the gaming machine. Redeemed must be used during the promotion period or lost; they cannot be cashed out. In this way, players are given incentive to visit the casino during times when the redemption periods are active to use these bonus credits toward game plays without using their own real credits. The casino can then drive players to the casino floor during off-peak hours by setting the redemption times during those hours. In particular, casinos can award increased redemption multipliers during the lowest off-peak times to further encourage play during those times.

In a half-price wager, each time a wager is placed by the player on the gaming device, half of the wager value is subtracted from the displayed amount and added to an internal EGM credit meter. For example, suppose a ten credit wager is placed with $4.00 showing on the account display 70 of a nickel slot machine with a 50 credit balance. The ten credits are removed from the internal EGM credit meter 70 and five credits of value equaling $0.25 are deducted from the number of redeemed credits. The five credits are simultaneously added to the credit meter 70. Thereafter, the coin-in display 72 shows a player bet of $0.50, the credit meter 70 shows an account balance of $3.75 and the VFD 58 shows a redeemed credit balance of 45. The player has just gotten a 10 credit wager while spending only five credits.

Having illustrated and described the principles of my invention in a preferred embodiment thereof, it should be readily apparent to those skilled in the art that the invention can be modified in arrangement and detail without departing from such principles. We claim all modifications coming within the spirit and scope of the accompanying claims.

What is claimed is:

1. A method of customizing play of a gaming device to a particular player level or group, said gaming device connected by a network to a host computer comprising:

creating a player account accessible by the host computer, said player account associated with a player;

storing within the player account one of a plurality of player levels;

allowing the player to play on the gaming device;

operating the gaming device responsive to the player level including:

tracking play of the player on the gaming device;

awarding to the player an award based on the player level of the player, said award being different that one awarded to a different player having a different player level; and further including:

associating a multiplier amount to each player level; and multiplying a base award by the multiplier amount to yield the award.

2. The method of claim 1, wherein the multiplier amount is higher for higher levels.

3. A method of customizing play of a gaming device to a particular player level or group, said gaming device connected by a network to a host computer comprising:

creating a player account accessible by the host computer, said player account associated with a player;

storing within the player account one of a plurality of player levels;

allowing the player to play on the gaming device;

operating the gaming device responsive to the player level including:

tracking play of the player on the gaming device;

awarding to the player an award based on the player level of the player, said award being different that one awarded to a different player having a different player level; and further including:

associating a threshold amount to each player level, said threshold amount being different for each player level; and awarding the award to the player only when the tracked play of the gaming machine by the player satisfies the threshold amount associated with the player level stored in the player account.

4. The method of claim 3, wherein the threshold amount is higher for higher level players.

5. The method of claim 3, wherein the award is higher for higher level players.

6. The method of claim 3, wherein the threshold amount and the award are higher for higher level players so that higher level players receive a more valuable award but must play more to receive the award.

7. The method of claim 3, further including:

associating additional threshold amounts to each player level above said first threshold amount; and awarding additional awards to the player when the tracked play of the gaming machine by the player satisfies those additional threshold amounts.

8. The method of claim 7, wherein the additional awards are higher for higher level players.

9. A method of customizing play of a gaming device to a particular player level or group, said gaming device connected by a network to a host computer comprising:

creating a player account accessible by the host computer, said player account associated with a player;

storing within the player account one of a plurality of player levels;

allowing the player to play on the gaming device;

operating the gaming device responsive to the player level including:

tracking play of the player on the gaming device;

awarding to the player an award based on the player level of the player, said award being different that one awarded to a different player having a different player level; wherein the award is a monetary award.

* * * * *

UNITED STATES PATENT AND TRADEMARK OFFICE

CERTIFICATE OF CORRECTION

PATENT NO. : 6,878,063 B2
APPLICATION NO. : 10/389633
DATED : April 12, 2005
INVENTOR(S) : Manfredi et al.

It is certified that error appears in the above-identified patent and that said Letters Patent is hereby corrected as shown below:

At column 2, line 29, please replace "ID)" with --ID--
At column 2, line 31, please replace "data f block" with --data block--
At column 8, line 6, please replace "Welcome Back In" with -- Welcome Back. In--
At column 13, line 39, please replace "FIG. 4" with --FIG. 4.--
At column 13, line 58, please replace "as, $1" with --as $1--
At column 14, line 32, please replace "Once the "At player's level" earned credit bonus is awarded, the player has no incentive to play further and must redeem the earned credits before accumulating more." With --Once the "At player's level" earned credit bonus is awarded, the player still has incentive to play further while preferred patrons are awarded more. By setting the earned credit multiplier for all levels to 1, all players would be awarded the same amount once they reached their normal level of play. That is, the level 1 and 3 players would each be awarded $10.00 in earned credits for playing $400. The level 5 player, not having reached the $500 "normal level of play," would receive $0.00.--
At column 14, line 60, please replace "FIG. 4" with --FIG. 4.--

Signed and Sealed this

Second Day of January, 2007

JON W. DUDAS
*Director of the United States Patent and Trademark Office*